US010568443B2

(12) United States Patent
Hampton

(10) Patent No.: US 10,568,443 B2
(45) Date of Patent: Feb. 25, 2020

(54) QUICK ASSEMBLY STRUCTURES, COMPONENTS, AND METHODS

(71) Applicant: WestRock Shared Services, LLC, Atlanta, GA (US)

(72) Inventor: Michael L. Hampton, Rogers, AR (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/012,854

(22) Filed: Jun. 20, 2018

(65) Prior Publication Data

US 2018/0360237 A1 Dec. 20, 2018

Related U.S. Application Data

(60) Provisional application No. 62/522,391, filed on Jun. 20, 2017.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC ..... A47F 5/116; A47F 5/112; A47F 5/114; A47F 2005/0075; A47B 43/02
USPC ..... 108/165, 157.14
See application file for complete search history.

(56) References Cited

U.S. PATENT DOCUMENTS 1,903,631 A * 4/1933 Morrison ..... A47B 3/12 108/150
2,003,821 A * 6/1935 Blake ..... A47B 3/04 108/157.14
2,745,617 A * 5/1956 Paige ..... A47F 5/114 211/133.1
3,566,808 A * 3/1971 Slate, Jr. ..... A47B 3/12 108/157.14
3,620,175 A * 11/1971 Crane et al. ..... A47B 3/12 108/157.14
3,705,557 A * 12/1972 Budington ..... A47B 3/00 108/150
3,724,399 A * 4/1973 Notko ..... A47B 3/12 108/150
4,078,502 A * 3/1978 Barna ..... A47B 3/06 108/150
4,374,560 A * 2/1983 Howlett ..... A47F 5/114 229/104
5,018,454 A * 5/1991 Negus ..... A47B 3/06 108/150
5,564,578 A * 10/1996 Smith ..... A47F 5/04 211/133.1

(Continued)

*Primary Examiner* — Jose V Chen
(74) *Attorney, Agent, or Firm* — WestRock IP Legal

(57) ABSTRACT

A collapsible structure (e.g., for use as a single or multi-tiered display table) can include a base having at least five hinges defined therein to define six or more base panels such that the base is foldable to form a shape with at least six sides, the base defining a first end and a second end that are attached to each other. The structure can include a first center support and a second center support. The first center support and the second center support can be attached together at the body of each center support and be configured to allow the base to move between a flat folded position and an open standing position by relative movement of the upper arms and the lower arms relative to the attached bodies of the center supports.

19 Claims, 19 Drawing Sheets

(56) References Cited

U.S. PATENT DOCUMENTS 5,678,492 A * 10/1997 Pinkstone ..... A47B 43/02 108/165
6,267,065 B1 * 7/2001 Lin ..... A47B 13/003 108/157.14
6,488,245 B1 * 12/2002 Maglione ..... A47F 5/112 248/135
6,807,912 B2 * 10/2004 Willy ..... A47B 3/06 108/157.14
8,020,497 B2 * 9/2011 Ossorguine ..... A47B 87/02 108/157.14
2003/0160015 A1 * 8/2003 Broerman ..... A47F 5/116 211/149
2004/0055515 A1 * 3/2004 Chen ..... A47B 13/00 108/157.14
2005/0006277 A1 * 1/2005 Moss ..... A47F 5/114 206/765
2005/0204968 A1 * 9/2005 Butkus ..... A47B 3/12 108/157.14
2008/0157582 A1 * 7/2008 Bertele ..... A47F 43/02 297/440.12
2011/0011814 A1 * 1/2011 Moss ..... A47F 5/112 211/73
2011/0192814 A1 * 8/2011 Chen ..... A47B 43/02 211/135
2014/0014602 A1 * 1/2014 Ray ..... A47F 1/04 211/59.2
2018/0160825 A1 * 6/2018 Abel ..... A47F 5/116

* cited by examiner

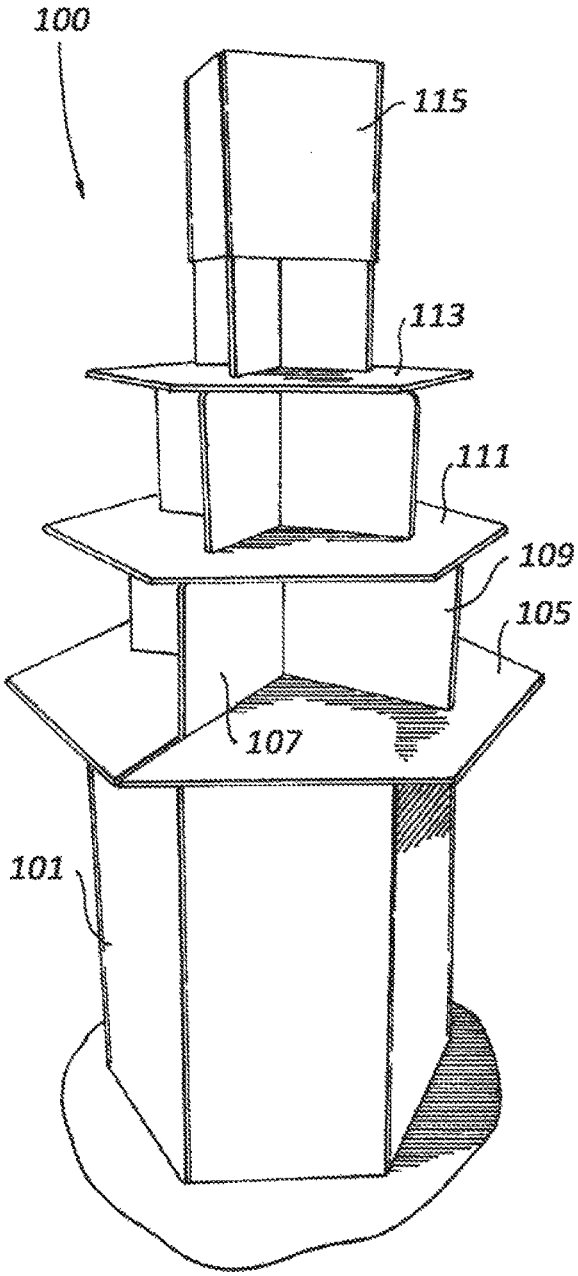
Fig. 1A
Fig. 1B
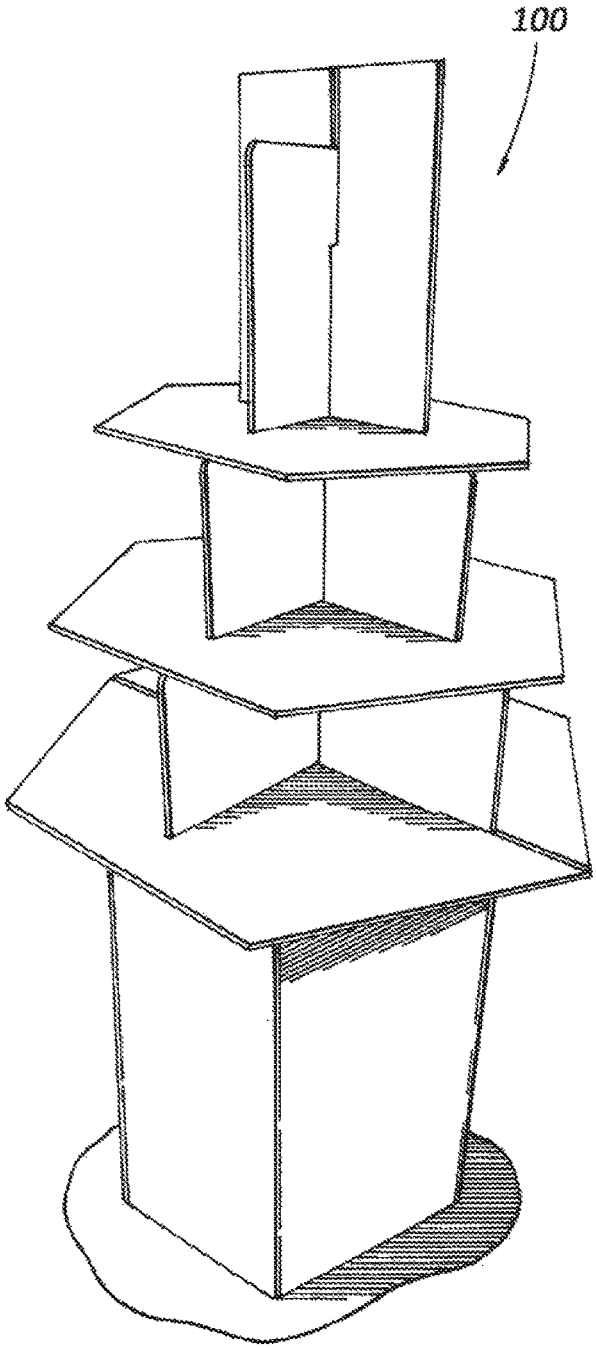

QUICK ASSEMBLY STRUCTURES, COMPONENTS, AND METHODS

CROSS-REFERENCE TO RELATED APPLICATIONS

This application claims priority to and the benefit of U.S. Provisional Application No. 62/522,391, filed Jun. 20, 2017, the contents of which are herein incorporated by reference in their entirety.

BACKGROUND

1. Field

The present disclosure relates to sheet products, e.g., corrugated paper board paper sheets, and structures made therefrom.

2. Description of Related Art

Certain structures can be assembled from paper or plastic sheets. In the field of retail, retailers can use display shelving that can require some measure of complex assembly that ultimately falls on the end user. Assembling retail displays can be time consuming. Also, the functionality of the ultimate structures are usually limited.

Such conventional methods and systems have generally been considered satisfactory for their intended purpose. However, there is still a need in the art for improved structures, components therefore, and methods therefore for, e.g., simplifying the assembly process and/or for providing added functionality. The present disclosure provides a solution for this need.

SUMMARY

A collapsible structure (e.g., for use as a single or multi-tiered display table) can include a base having at least five hinges defined therein to define six or more base panels such that the base is foldable to form a shape with at least six sides, the base defining a first end and a second end that are attached to each other. The structure can include a first center support and a second center support. Each center support can include a body an upper arm defined by a first arm hinge and extending from the body, and configured to fold relative to the body, and a lower arm defined by a second arm hinge and extending from an opposite side of the body as the upper arm, and configured to fold relative to the body. The first center support can be attached to a first panel of the base within the base by the upper arm and lower arm of the first center support, and the second center support can be attached to a second panel of the base within the base by the upper arm and lower arm of the second center support. The second panel can be spaced from the first panel. The first center support and the second center support can also be attached together at the body of each center support and be configured to allow the base to move between a flat folded position and an open standing position by relative movement of the upper arms and the lower arms relative to the attached bodies of the center supports.

The upper arms of each center support can extend from the base at least in the flat folded position. The upper arms and the lower arms can fold to a horizontal position when structure is moved to the open standing position.

The structure can further include a first table section attached to the upper arm of the first center support and outside of the base, and a second table section attached to the upper arm of the second center support and outside of the base. In this regard, when moved to the open standing position, the table sections can be moved horizontal to at least partially form a table.

Each center support can include a bottom hinge defining a bottom attachment tab on the lower arm and a top hinge defining a top attachment tab on the upper arm, wherein the each center support is attached to the base at the each attachment tab. Each center support can be folded over the bottom attachment tab.

The base can include includes an attachment tab at the second end of the base that is defined by an additional hinge. The attachment tab can be configured to attach to an end panel of the base.

The upper arms can include an upper arm slit. The table sections can each include a first section slit defined therein aligned with the upper arm slits and perpendicular to the body, and a second section slit perpendicular to the upper arm slits such that, in the open standing position, the table sections define a cross-shaped opening. In certain embodiments, the body of each center support can include a cut out between the upper arm and the body.

The structure can further include a cross support configured to insert into the cross-shaped opening in the table sections and to secure to the body. The cross support member can include a first cross support member interfaced with a second cross support member connected to each other and configured to fold between a cross flat position and cross open position.

The first cross support member can include a central bottom slit configured to slide over the body within the base. The second cross support member includes a central upper slit configured to receive the first cross-support member to form the cross support. Each cross support can include a bottom tab that inserts through the cross shaped opening in the table (e.g., which can stabilize the cross support in the table).

The structure can include at least one shelf member. Each shelf member can include a cross opening configured to slide onto the cross member and rest on a set of ribs of the cross support. In certain embodiments, the cross support can include successively smaller diameter sets of ribs. Each shelf can include a cross opening, wherein each successively higher shelf includes a smaller cross opening to rest on successive sets of ribs of the cross support.

In certain embodiments, the structure can include a hat configured to form a box to cover a top portion of the cross member, wherein the hat is configured to web across the edges of the cross support. Each component can be made of corrugated paper or any other suitable material (e.g., corrugated plastic). Any hinges disclosed herein can include a living hinge defined by at least one of fold lines, score lines, intermittent cuts, and/or rail scores. Any other suitable type(s) of hinge(s) is contemplated herein.

In accordance with at least one aspect of this disclosure, a blank (e.g., made of corrugated paper) for a center support member of a collapsible display table structure can include a body, an upper arm defined by a first arm hinge and extending from the body, and configured to fold relative to the body, wherein the upper arm defines a slit, and a lower arm defined by a second arm hinge and extending from an opposite side of the body as the upper arm, and configured to fold relative to the body, a bottom hinge defining a bottom attachment tab on the lower arm and a top hinge defining a top attachment tab on the upper arm, wherein the each center support is configured to be attached to the base at the each attachment tab, wherein when the body is attached together with at the body of another center support, the center support is configured to allow the base to move between a flat folded position and an open standing position by relative movement of the upper arms and the lower arms relative to the attached bodies of the center supports, wherein the upper arms and the lower arms are configured to fold to a horizontal position when structure is moved to the open standing position.

In accordance with at least one aspect of this disclosure, a method for assembling a collapsible structure can include providing a base (e.g., as disclosed above), e.g., having at least five hinges defined therein to define six base panels such that the base is foldable to form a hexagon. The method can include providing any suitable first center support and second center support as disclosed herein.

The method can include attaching the first center support to a first panel of the base by the lower attachment tab of the first center support. The method can include attaching a second center support to a second panel of the base by the lower attachment tab of the second center support. The second panel can be spaced from the first panel by two intermediate panels.

The method can include folding the first center support over the lower attachment tab to bring the first center support across the base and folding the second center support over the lower attachment tab to bring the second center support across the base. The method can include folding the upper arm of the first center support over and attaching the first center support to a first panel of the base by the top attachment tab of the first center support. The method can also include folding the upper arm of the second center support over and attaching the second center support to a second panel of the base by the top attachment tab of the second center support and folding the base between the two intermediate panels such that the body of each of the first center support and the second center support contact and join together via an adhesive or tape.

The method can include attaching a first end of the base to a second end of the base to enclose the center supports within the base such that the first center support and the second center support are configured to allow the base to move between a flat folded position and an open standing position by relative movement of the upper arms and the lower arms relative to the attached bodies of the center supports. The method can also include attaching a first table section and a second table section to the upper arm of the first center support and the second center support after enclosing the center supports in the base such that, in the open standing position, the first and second table sections sit on the upper arms to form a table having a cross-shaped opening therein.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIGS. 1A and 1B show perspective views of an embodiment of a structure in accordance with this disclosure (e.g., which can be used for a collapsible retail display or any other suitable use);

DETAILED DESCRIPTION

Figure 2:
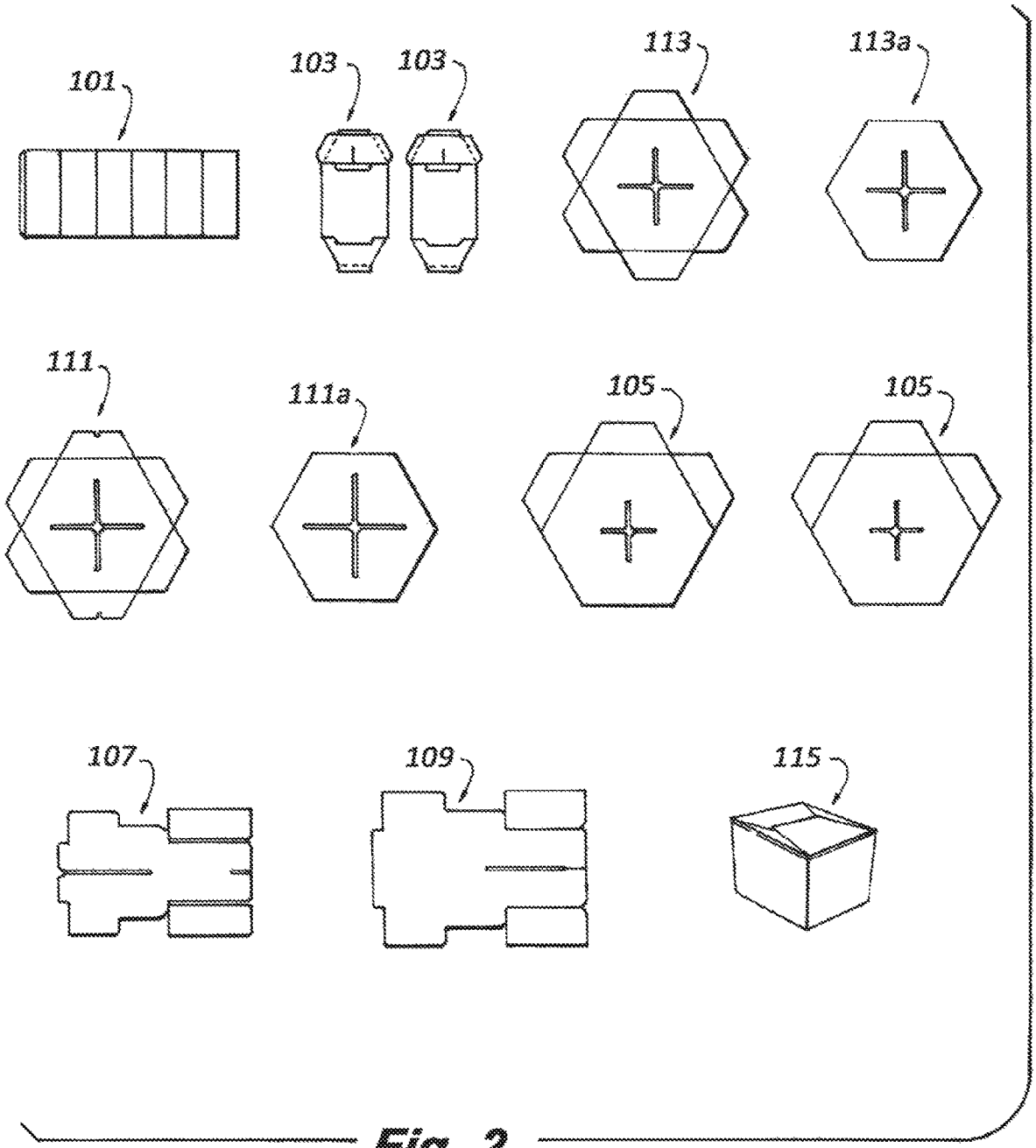
FIG. 2 shows an embodiment of a kit of blanks for forming a structure, e.g., the structure of FIG. 1 in accordance with this disclosure.

Reference will now be made to the drawings wherein like reference numerals identify similar structural features or aspects of the subject disclosure. For purposes of explanation and illustration, and not limitation, an illustrative view of an embodiment of a structure in accordance with the disclosure is shown in FIGS. 1A and 1B and is designated generally by reference character 100. Other embodiments and/or aspects of this disclosure are shown in FIGS. 2A-6B. The systems and methods described herein can be used to provide quick assembly display structures (e.g., for use by a retailer), or for any other suitable use or structure.

Figure 3A:
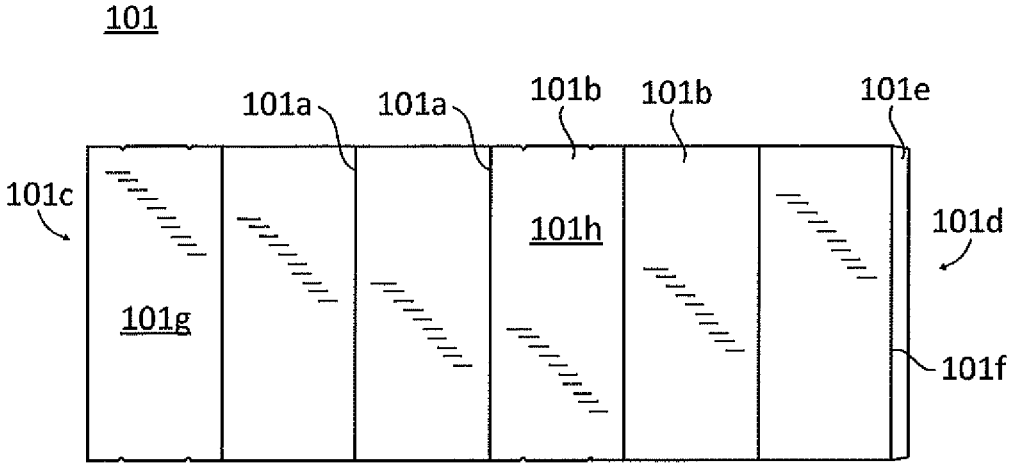
FIGS. 3A-3J show an example set of blanks of the kit of FIG. 2 used to make a structure (e.g., as shown in FIG. 1) in accordance with this disclosure.

Referring to FIGS. 1A and 1B, a collapsible structure 100 (e.g., for use as a single or multi-tiered display table) is shown. Referring additionally to FIGS. 2 and 3A, the structure 100 can include a base 101 having at least five hinges 101*a*, defined therein to define six or more base panels 101*b* such that the base 101 is foldable to form a tube around an interior space with, e.g., at least six vertical sides (e.g., a hexagon). Any other suitable number of hinges 101*a*, and/or panels 101*b* are contemplated herein to form any suitable shape (e.g., a sixteen side shape). Each of the hinges 101*a* in the base 101 can be a single score line living hinge or any other suitable hinge.

The base 101 can define a first end 101*c* and a second end 101*d* that are configured to attached to each other. In certain embodiments, the base 101 can include an attachment tab 101*e* at the second end 101*d* of the base 101 that is defined by an additional hinge 101*f*. The attachment tab 101*e* can be configured to attach to an end panel (e.g., adjacent end 101*c* on an inside surface thereof) of the base 101. As shown in FIGS. 1A and 1B, the ends 101*c*, 101*d* are connected together.

Figure 3B:
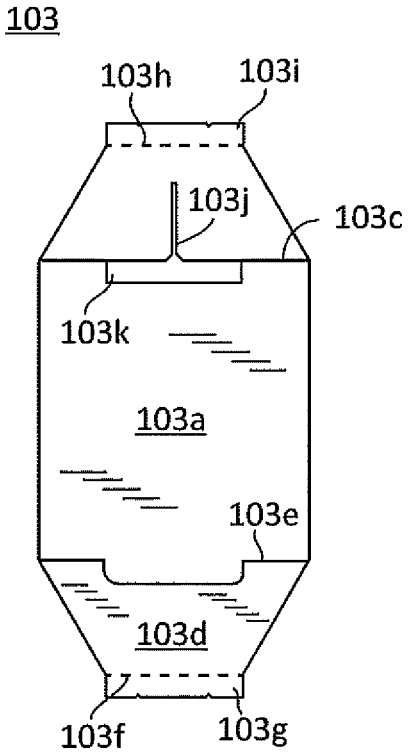

Referring additionally to FIG. 3B, the structure 100 can include a plurality of center supports 103. The center supports can include a first center support 103 and a second center support 103, which can be identical or varied in any suitable manner. Each center support 103 can include a body 103*a*, an upper arm 103*b* defined by a first arm hinge 103*c* and extending from the body 103*a*, and configured to fold relative to the body 103*a*. Each center support 103 can also include a lower arm 103*d* defined by a second arm hinge 103*e* and extending from an opposite side of the body 103*a* as the upper arm 103*b*, and configured to fold relative to the body 103*a*.

The first center support 103 can be attached to a first panel (e.g., panel 101*g*) of the base within the base 101 (e.g., on an inside surface thereof) by the upper arm 103*b* and lower arm 103*d* of the first center support 103. The second center support 103 can be attached to a second panel (e.g., panel

Figure 6A:
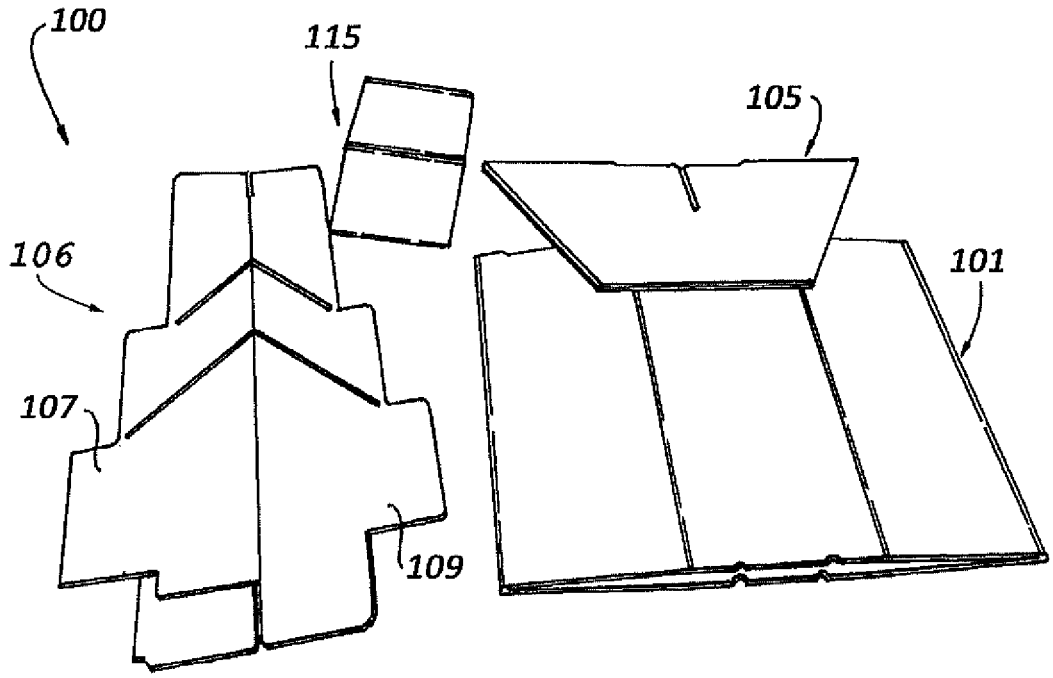
FIG. 6A is a perspective view of portions of an embodiment of a kit shown in the flat folded position.
Figure 6B:
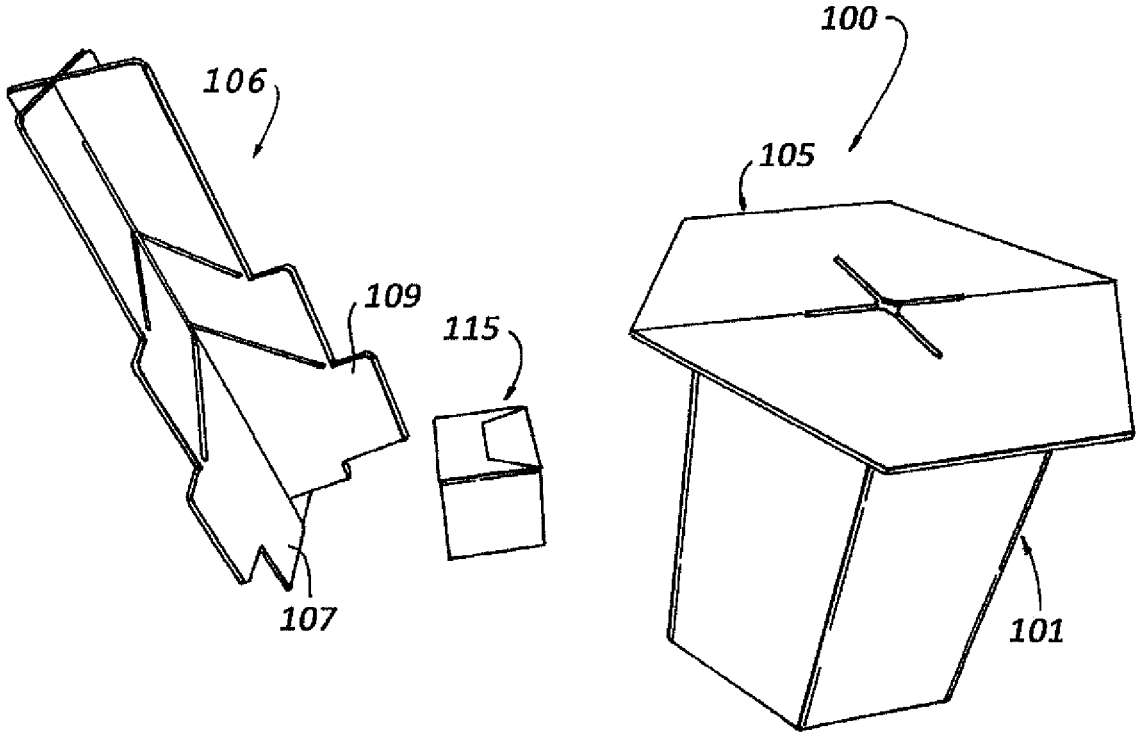
FIG. 6B is a perspective view of the portions of an embodiment of a kit shown in the flat folded position.

101*h*) of the base 101 within the base 101 (e.g., on an inside surface thereof) by the upper arm 103*b* and lower arm 103*d* of the second center support 103. The second panel can be spaced from the first panel (e.g., by two panels as shown). The first center support 103 and the second center support 103 can also be attached together at the body 103*a* of each center support 103 and still be configured to allow the base 101 to move between a flat folded position (e.g., as shown in FIG. 6A) and an open standing position (e.g., as shown in FIGS. 1A and 1B, and in FIG. 6B) by relative movement of the upper arms 103*b* and the lower arms 103*d* relative to the attached bodies 103*a* of the center supports 103. The spacing and attachment locations between first center support 103 and the second center support can be any suitable spacing to allow the base 101 to open from the flat folded position to the open standing position when the bodies 103*a* of the center supports 103 are attached together.

The upper arms 103*b* of each center support 103 can extend from the base 101 at least in the flat folded position. The upper arms 103*b* and the lower arms 103*d* can fold to a horizontal position when structure 100 is moved to the open standing position, for example. Any other suitable extension angle is contemplated herein.

Each center support 103 can include a bottom hinge 103*f* defining a bottom attachment tab 103*g* on the lower arm 103*d* and a top hinge 103*h* defining a top attachment tab 103*i* on the upper arm 103*b*. Each center support 103 can be attached to the base 101 at the each attachment tab 103*g*, 103*i*. Each hinge 103*c*, 103*e*, 103*f*, 103*h*, can include a single score line living hinge or any other suitable type of hinge. In certain embodiments, the side of the center support 103 that includes a score line for the hinges 103*h* and 103*f* can be the opposite side from the side that has a score line for hinges 103*c* and 103*e*.

Each center support 103 can be folded over the bottom attachment tab 103*g* after the bottom tab 103*g* is attached to the base 101. In certain embodiments, the upper arms 103*b* can include an upper arm slit 103*j*. In certain embodiments, the body 103*a* of each center support 103 can include a cut out 103*k* between the upper arm 103*b* and the body 103*a*, which can be configured to receive a bottom tab of a cross support as described below.

Figure 3C:
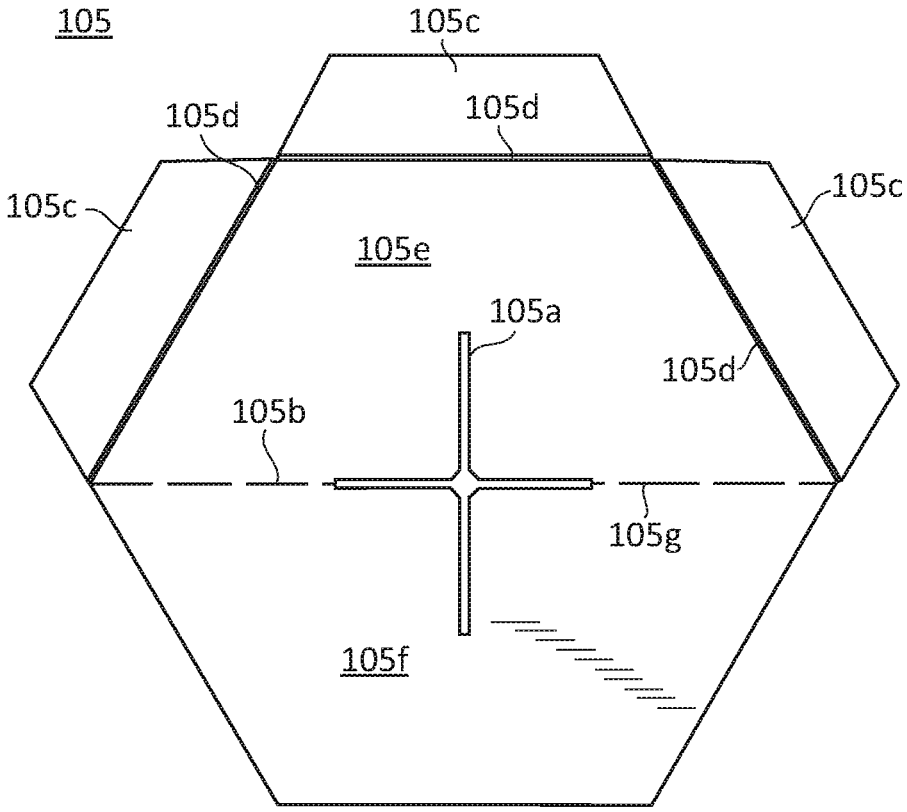

Referring additionally to FIG. 3C, the structure 100 can further include a first table section 105 attached to the upper arm 103*b* of the first center support 103 and outside of the base 101, and a second table section 105 attached to the upper arm 103*b* of the second center support 103 and outside of the base 101. In this regard, when moved to the open standing position, the table sections 105 can be moved horizontal to at least partially form a table, e.g., as shown in FIGS. 1A and 1B. Any other suitable non-horizontal position is contemplated herein.

The table sections 105 can each include a first section slit 105*a* defined therein aligned with the upper arm slits 103*j* and perpendicular to the body 101*a* (e.g., to allow a cross support to insert therethrough and to fit a slot thereof over the attached bodies 101*a* of the two center supports 103). The table sections 105 can include a second section slit 105*b* perpendicular to the upper arm slits 103*j* such that, in the open standing position, the table sections 105 define a cross-shaped opening as shown in FIG. 3C. The second section slit 105*b* can be a different length (e.g., shorter) than the first section slit 105*a*, e.g., which can allow for a cross support as described herein to only be inserted therein in one orientation.

The table sections 105 can include one or more flaps (e.g., one for three sides of the hexagonal shape) hinged (e.g., with a rail score as shown, or any other suitable hinge type) to a section body 105*e* of the table sections 105. The section body 105*e* can include a second half 105*f* that is either hinged or cut at line 105*g*. The second half 105*f* can be placed under the body 105*e* in alignment with all sides, and can be secured to the body 105*e* using the one or more flaps 105*c* when the flaps are folded over and are adhered (e.g., with glue or tape) to the second half 105*f*. The second half 105*f* can also be adhered to the underside of the section body 105*e*. Using the second half 105*f* in this manner can provide a stronger structure for the table section 105. As shown, the table sections 105 each form half of a table top, however, it is contemplated that the table top can be formed by any suitable number of table sections 105.

Figure 3D:
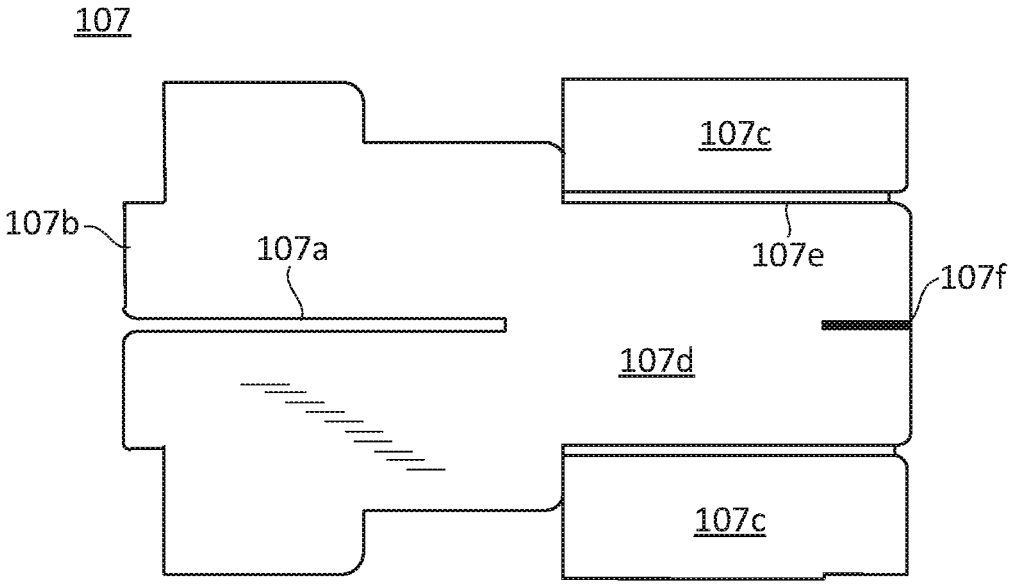
Figure 3E:
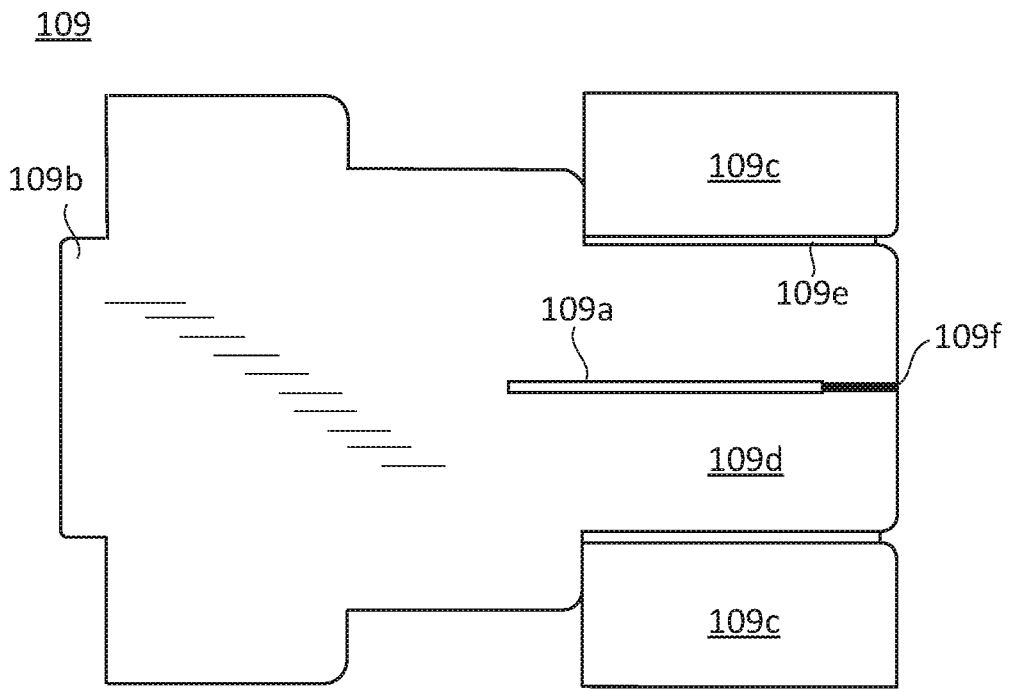

The structure 100 can further include a cross support 106 configured to insert into the cross-shaped opening formed by the table sections 105 on the open standing position. The cross support 106 can be configured to secure to the body 103*a* of the center support 103. Referring additionally to FIGS. 3D and 3E, the cross support member 106 can include a first cross support member 107 interfaced with a second cross support member 109 connected to each other and configured to fold between a cross flat position and cross open position.

The first cross support member 107 can include a central bottom slit 107*a* configured to slide over the attached bodies 103*a* of the center supports 103 within the base 101. The second cross support member 109 can include a central upper slit 109*a* configured to receive the first cross support member 109 to form the cross support 106.

Each cross support member 107, 109 can include a bottom tab 107*b*, 109*b* that inserts through the cross shaped opening in the table defined by the table sections 105 (e.g., which can stabilize the cross support in the table). As described above, the second section slit 105*b* can be a different length (e.g., shorter) than the first section slit 105*a*, e.g., which can allow for a cross support 106 to only be inserted therein in one orientation. The bottom tab 107*b* can be sized to fit only in the first section slit 105*a*, for example, and the bottom tab 109*b* can be sized to fit in the second section slit 105*b*. This can cause the central bottom slit 107*a* to be oriented properly to slide over the attached bodies 103*a* of the center supports 103*a* when inserted, which prevents improper assembly.

As shown, the cross support members 107, 109 can include one or more reinforcement panels 107*c*, 109*c*, each connected to a cross body 107*d*, 109*d* by a hinge 107*e*, 109*e* (e.g., a rail score hinge). The reinforcement panels 107*c* can be folded over and adhered to the body 107*d* (e.g., with tape or glue) to make the cross support members 107, 109 stronger. The reinforcement panels 107*c*, 109*c* can be shaped to match a shape of the body 107*e* when folded over.

The first cross support member 107 can include an upper slit 107*f* configured to receive mating slip 109*f* of the second cross support member 109. When the first cross support member 107 is interfaced with the second cross support member (e.g., by sliding the central bottom slit 107*a* over the central upper slit 109*a* until the bodies 107*d*, 109*d* contact), the mating slip 109*f* can clip together in the upper slit 107*f* and/or rest on the body 107*d* of the first cross support member 107.

Figure 3F:
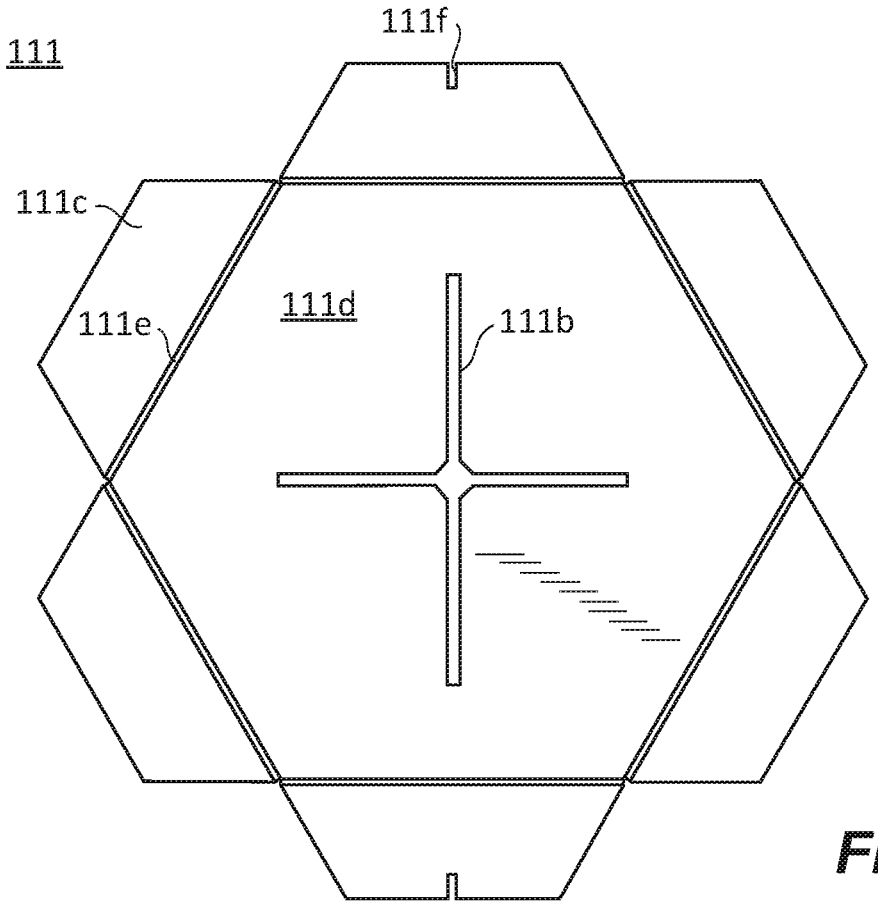
Figure 3G:
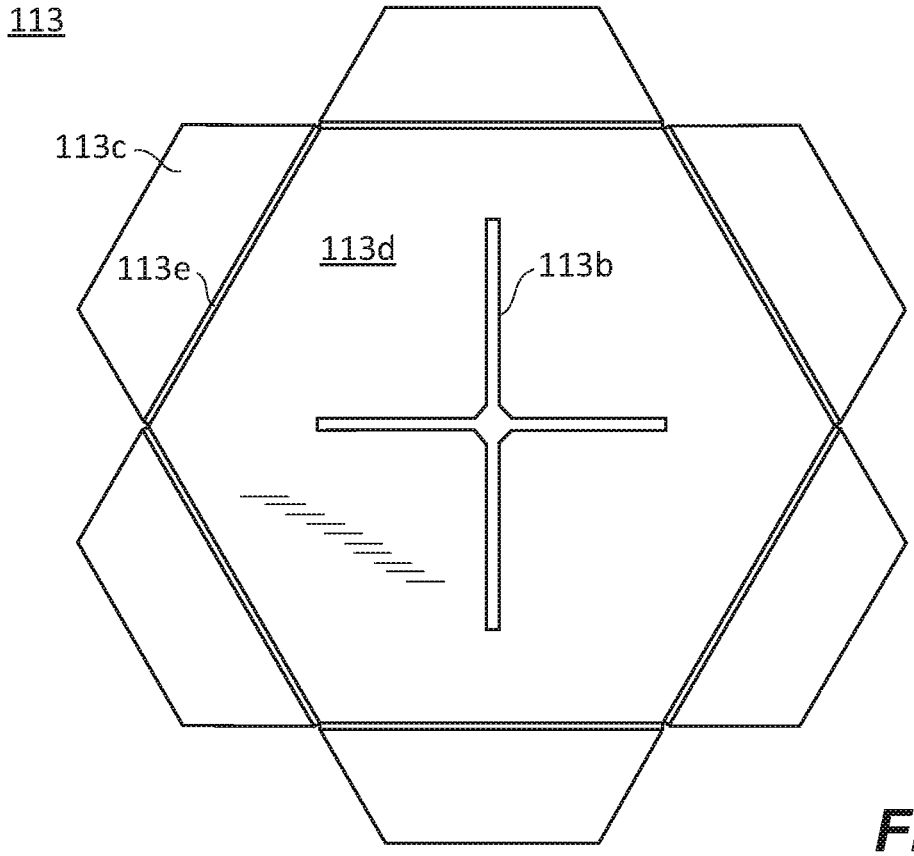

Referring additionally to FIGS. 3F and 3G, the structure 100 can include at least one shelf member 111, 113. Each shelf member 111, 113 can include a cross opening 111*b*, 113*b* configured to slide onto the cross member 106 and rest on a set of ribs 106*a*, 106*b* of the cross support 106. The sets of ribs 106*a*, 106*b* can be defined by the shape of each cross support member 107, 109. As shown, in certain embodiments, the cross support 106 can include successively smaller diameter sets of ribs 106*a*, 106*b* (e.g., in the vertical direction such that the outer diameter of the ribs become smaller in the upward direction). Each shelf 111, 113 can include a cross opening 111*a*, 113*b* such that each successively higher shelf includes a smaller cross opening to rest on successive sets of ribs of the cross support. For example, the cross opening 111*b* of middle shelf 111 can have longer length cross slits to slide over the upper set of ribs 106*b*, but not large enough to pass the lower set of ribs 106*a* such that the middle shelf 111 can sit on the lower set of ribs 106*a*.

Figure 3H:
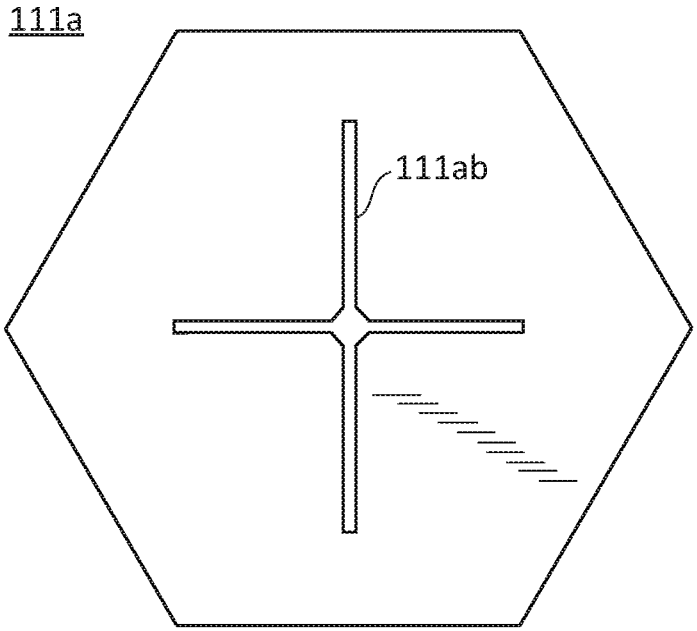
Figure 3I:
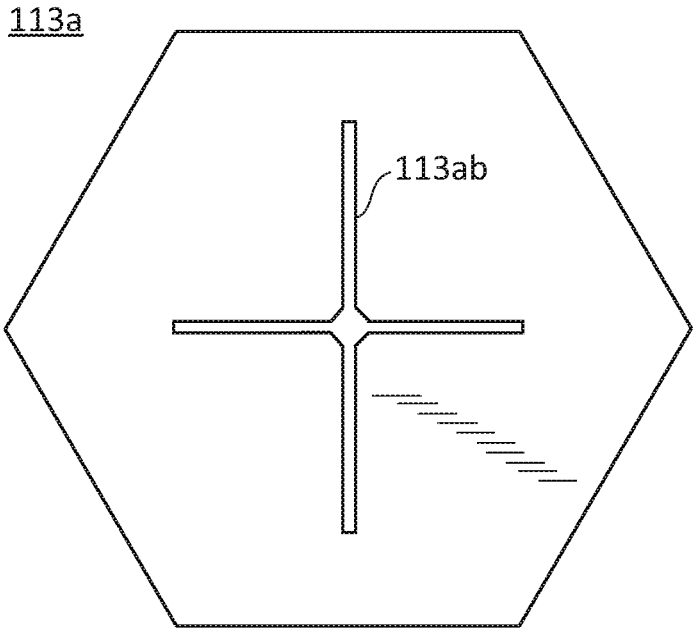

Referring additionally to FIGS. 3H and 31, one or more pads 111*a*, 113*a* can be attached to the one or more shelves 111, 113 respectively. For example, as shown, the one or more shelves 111, 113 can include one or more flaps 111*c*, 113*c* attached to a shelf body 111*d*, 113*d* by a one or more hinges 111*e*, 113*e* (e.g., rail score living hinges) such that the one or more flaps 111*c*, 113*c* can fold over onto the one or more pads 111*a*, 113*a* (e.g., which can be the same thickness corrugated paper board as the shelves 111, 113) and be adhered thereto (e.g., with glue or twin tape) to retain the pads 111*a*, 113*a* to the shelves 111, 113.

The pads 111*a*, 113*a* can include a cross opening 111*ab*, 113*ab* that is the same or similar to the cross openings 111*b*, 113*b* so that the pads 111*a*, 113*a* do not block the cross openings 111*b*, 113*b* of the shelves 111, 113. As shown in FIG. 3F, one or more of the flaps 111*c* may include a slit 111*f* such that the one or more flaps 111*c* do not block the cross opening 111*b*, 113*b* in when folded over.

Figure 3J:
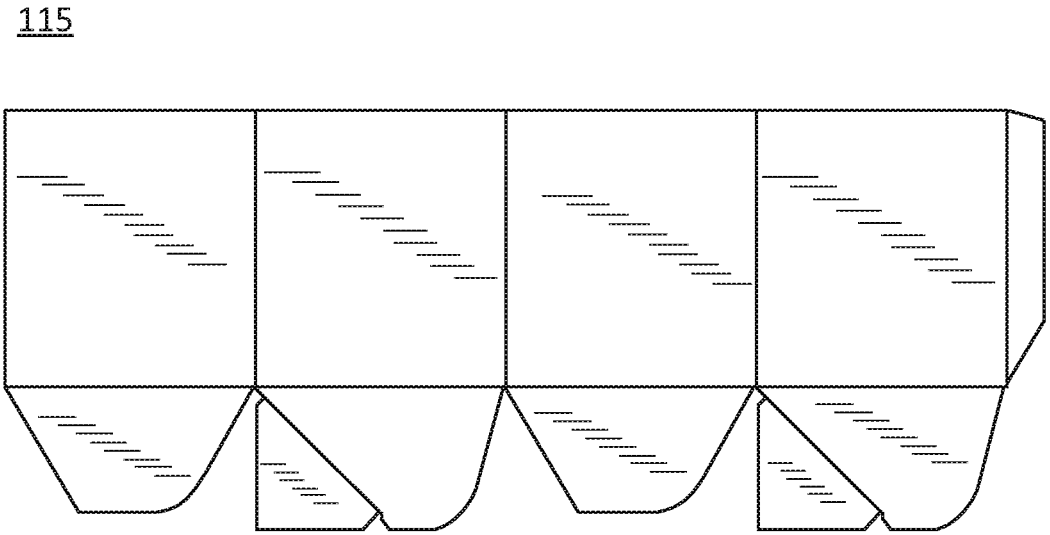

In certain embodiments, referring additionally to FIG. 3J, the structure 100 can include a hat 115 configured to form a box to cover a top portion of the cross member 106, e.g., as shown in FIG. 1 such that the hat is configured to web across the edges of the cross support. The hat 115 can be configured to fold flat after having ends attached, and to move to an open position to form a box. It is contemplated that no hat 115 is needed as shown in FIG. 2, or that any other suitable shape hat can be used.

Any components described herein can be made of corrugated paper (e.g., cardboard) or any other suitable material (e.g., corrugated plastic). Any components described herein can be printed or stamped to make the blanks as shown, and/or in any other suitable manner as appreciated by those having ordinary skill in the art in view of this disclosure. Any hinges disclosed herein can include a living hinge defined by at least one of fold lines, score lines, intermittent cuts, and/or rail scores. Any other suitable type(s) of hinge(s) is/are contemplated herein.

Figure 4A:
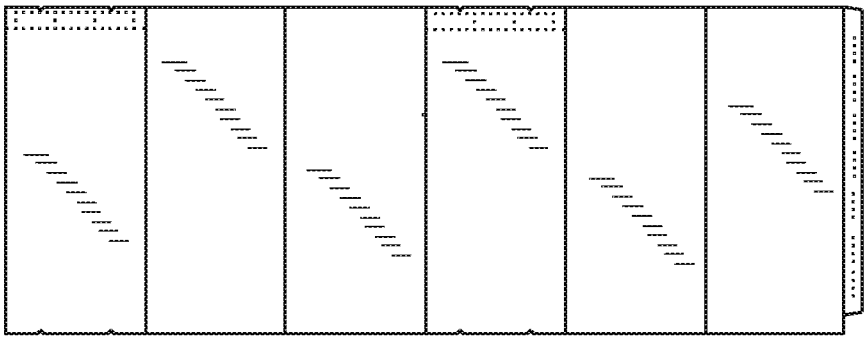
FIGS. 4A-4J show another example set of blanks of the kit of FIG. 2 used to make a structure (e.g., as shown in FIG. 1) in accordance with this disclosure.
Figure 4B:
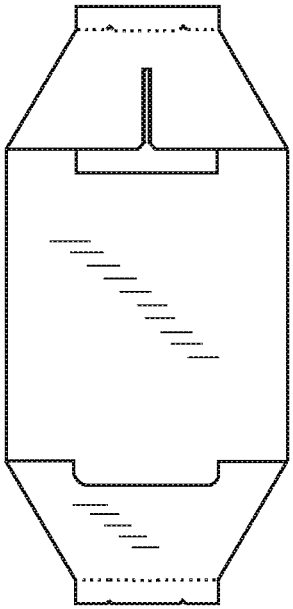
Figure 4C:
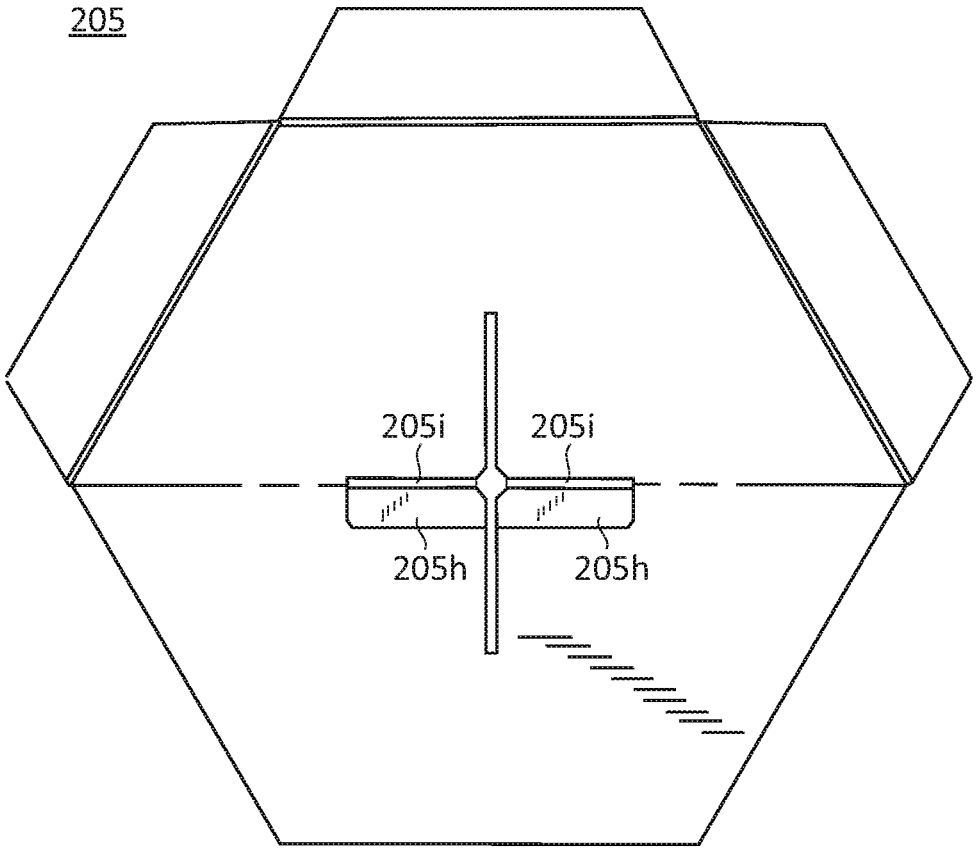
Figure 4D:
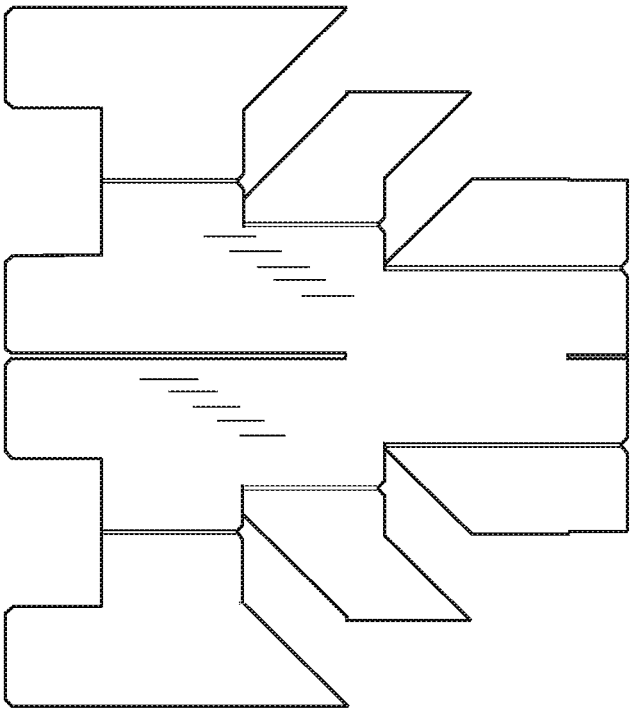
Figure 4D:
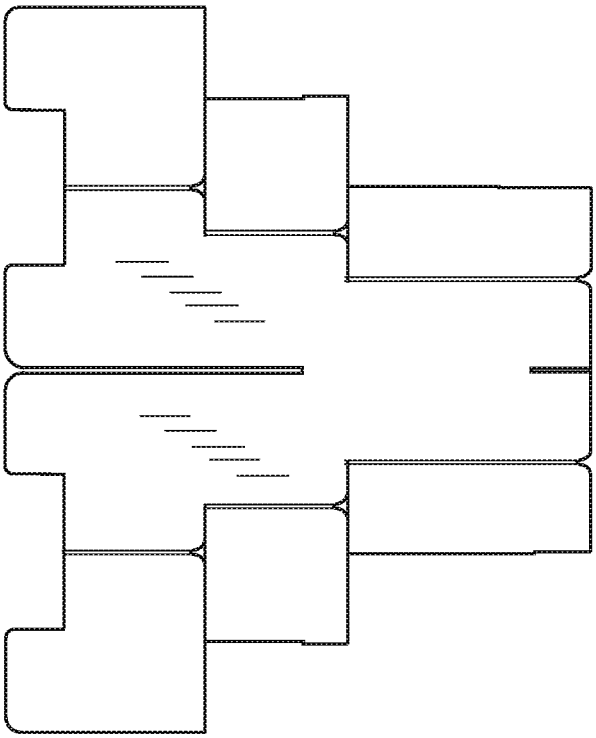
Figure 4E:
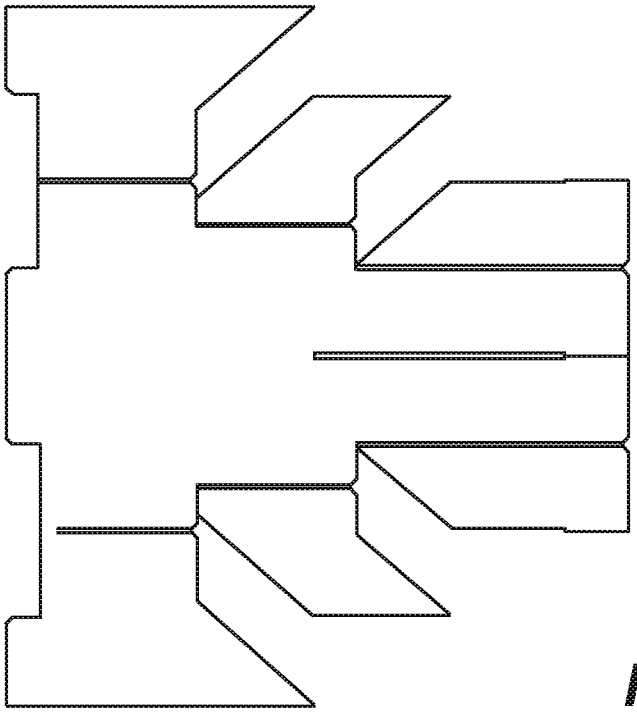
Figure 4F:
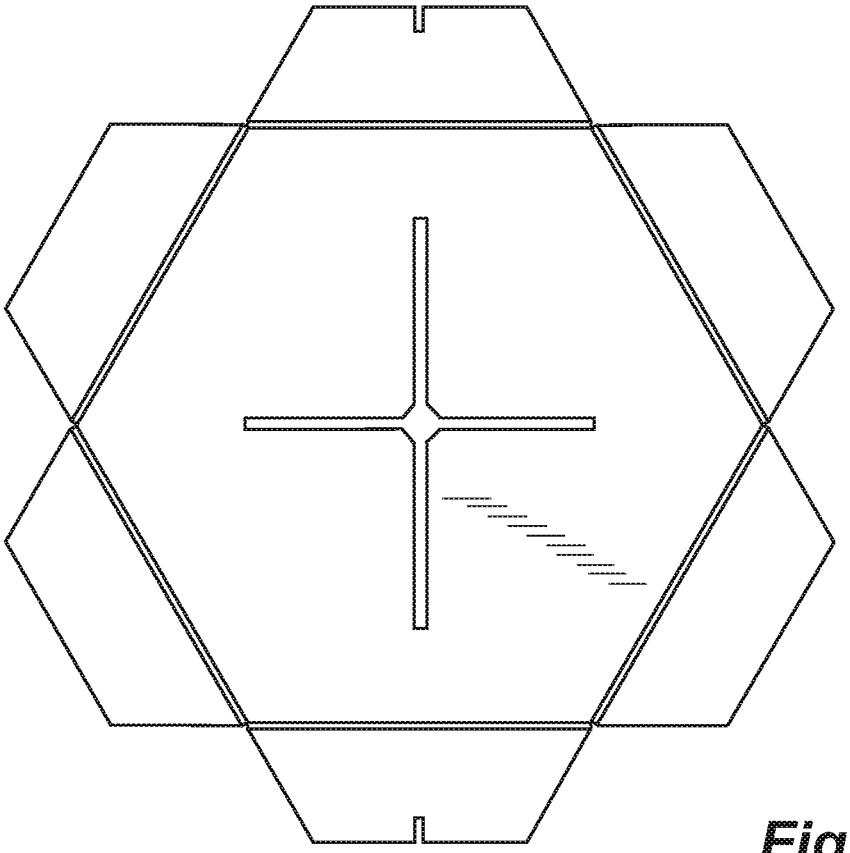
Figure 4G:
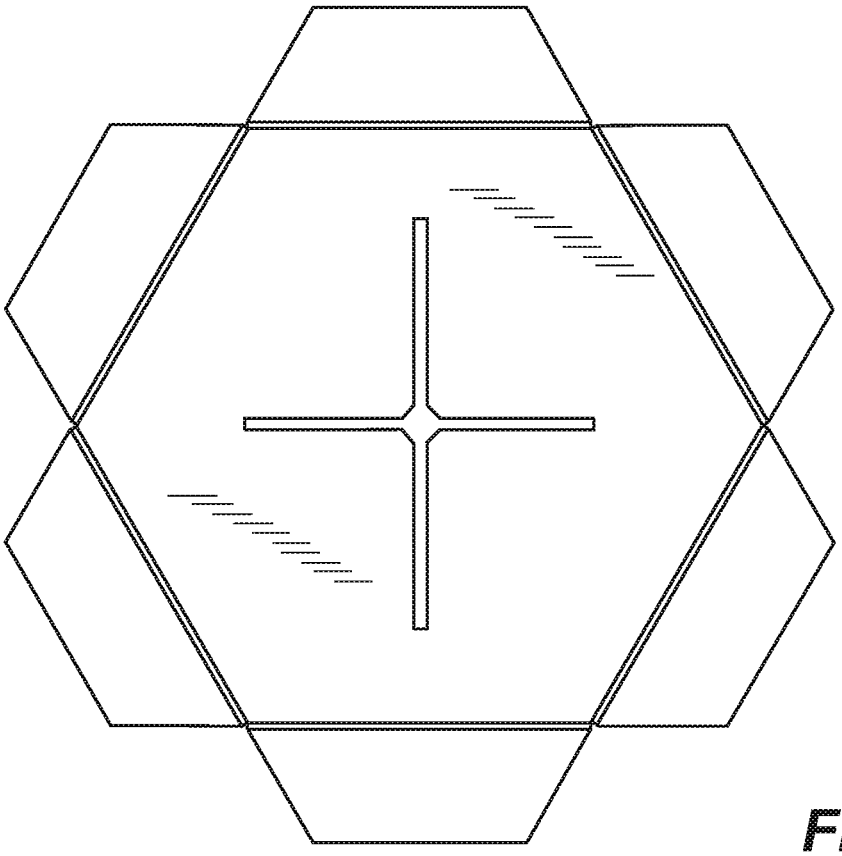
Figure 4H:
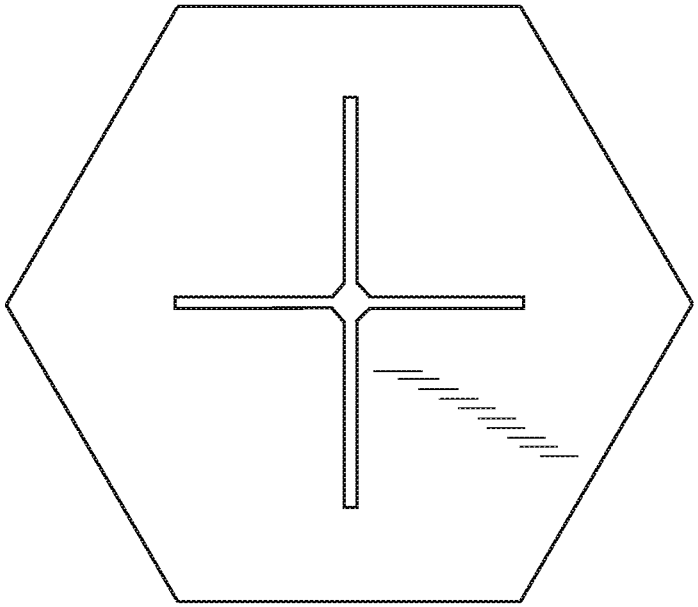
Figure 4I:
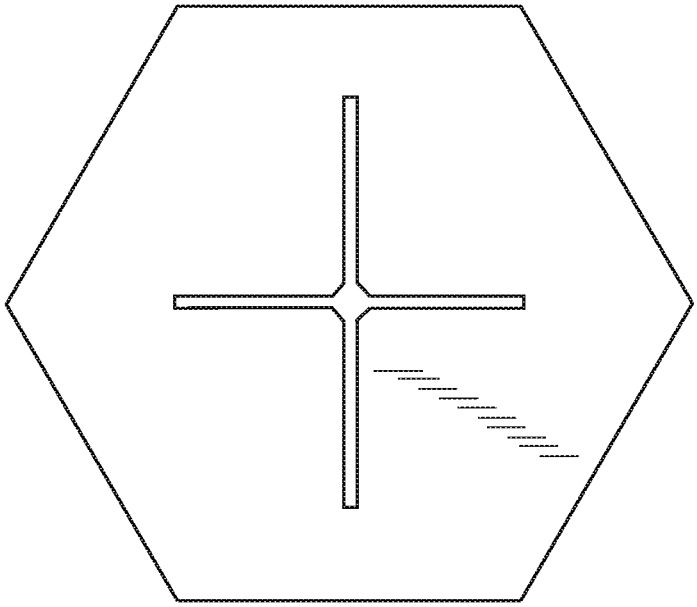
Figure 4J:
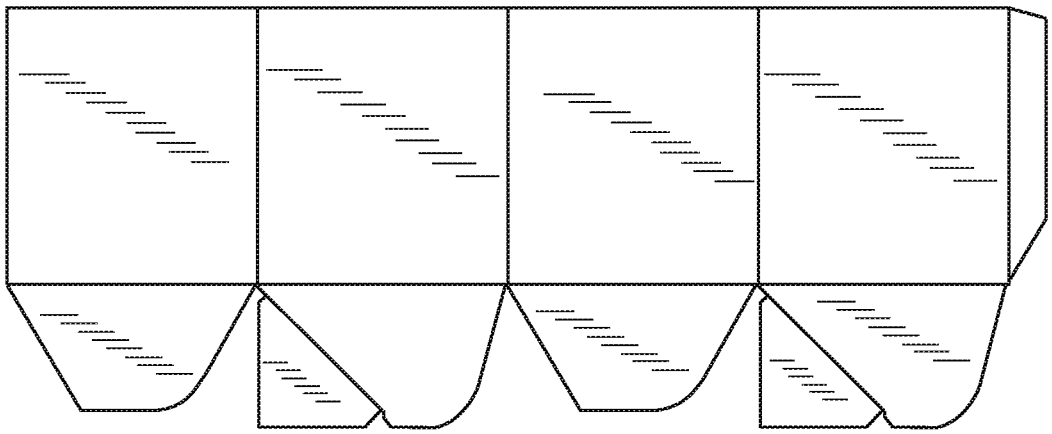

FIGS. 4A-4J show another embodiment of the components used in a kit as shown in FIG. 2, and as shown in FIGS. 3A-3J. FIG. 4A shows another embodiment of a base in accordance with this disclosure with similar features as base 101 except having inside crush area and/or tick marks to indicate where to attach the first and second center supports 103. FIG. 4B shows another embodiment of a center support 103 shown having tick marks. FIG. 4C shows another embodiment of a table section 205 that can include one or more retainer tabs 205*h* configured to fold about joint 205*i* and fit through cut out 103*k* in a center support 103 to be attached to an underside of the upper arm 103*b* center support 103 (e.g., for added strength), wherein the tabs 205*h* can be the same dimension as the cut out 103*k* in certain embodiments which can allow the table to fold flat. FIGS. 4DA and 4DB show two other embodiments of a first cross support member. FIG. 4E shows another embodiment of a second cross support member.

Any components as disclosed herein can be folded from a blank (e.g., made of stamped corrugated paper). In accordance with at least one aspect of this disclosure, a method for assembling a collapsible structure can include providing a base (e.g., as disclosed above), e.g., having at least five hinges defined therein to define six base panels such that the base is foldable to form a hexagon. The method can include providing any suitable first center support and second center support as disclosed herein.

The method can include attaching the first center support to a first panel of the base by the lower attachment tab of the first center support. The method can include attaching a second center support to a second panel of the base by the lower attachment tab of the second center support. The second panel can be spaced from the first panel by two intermediate panels.

The method can include folding the first center support over the lower attachment tab to bring the first center support across the base and folding the second center support over the lower attachment tab to bring the second center support across the base. The method can include folding the upper arm of the first center support over and attaching the first center support to a first panel of the base by the top attachment tab of the first center support. The method can also include folding the upper arm of the second center support over and attaching the second center support to a second panel of the base by the top attachment tab of the second center support and folding the base between the two intermediate panels such that the body of each of the first center support and the second center support contact and join together via an adhesive or tape.

The method can include attaching a first end of the base to a second end of the base to enclose the center supports within the base such that the first center support and the second center support are configured to allow the base to move between a flat folded position and an open standing position by relative movement of the upper arms and the lower arms relative to the attached bodies of the center supports. The method can also include attaching a first table section and a second table section to the upper arm of the first center support and the second center support after enclosing the center supports in the base such that, in the open standing position, the first and second table sections sit on the upper arms to form a table having a cross-shaped opening therein.

Figure 5A:
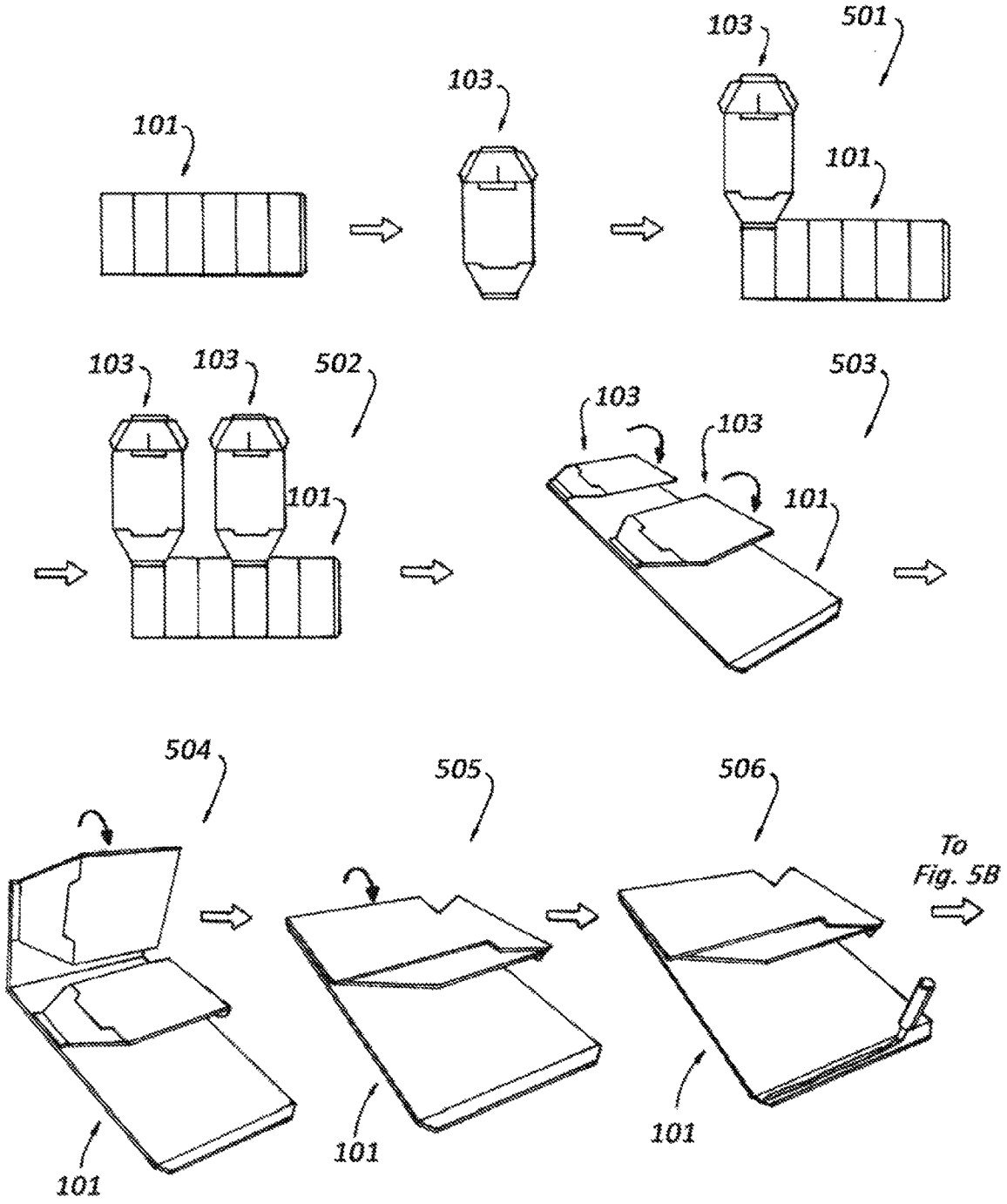
FIGS. 5A-5E are graphical numbered flow diagrams of an embodiment of a method in accordance with this disclosure.

An embodiment of a method is graphically illustrated in FIGS. 5A-5E. While the steps are shown in a certain order, it is contemplated that the order of steps can be modified in any suitable manner where possible as appreciated by those having ordinary skill in the art. Referring to FIG. 5A, embodiments can include adhering (e.g., at 501; using glue or tape) a first center support 103 to the base 101 (e.g., at a sixth panel), and then adhering (e.g., at 503) a second center support 103 to another portion of the base 101 (e.g., at a fourth panel). The method can include the folding (e.g., at 503) the center support 103 over and adhering at the bottom (e.g., where V marks may be located). The method can include folding (e.g., at 504) the base 101 so that the center supports 103 are directly together (e.g., to adhere the bodies 103*a* thereof together). The method can include (e.g., at 505) placing a weight to hold the assembly in place. The method can include (e.g., at 506) applying glue or tape to the attachment tab 101*e* of the base 101.

Figure 5B:
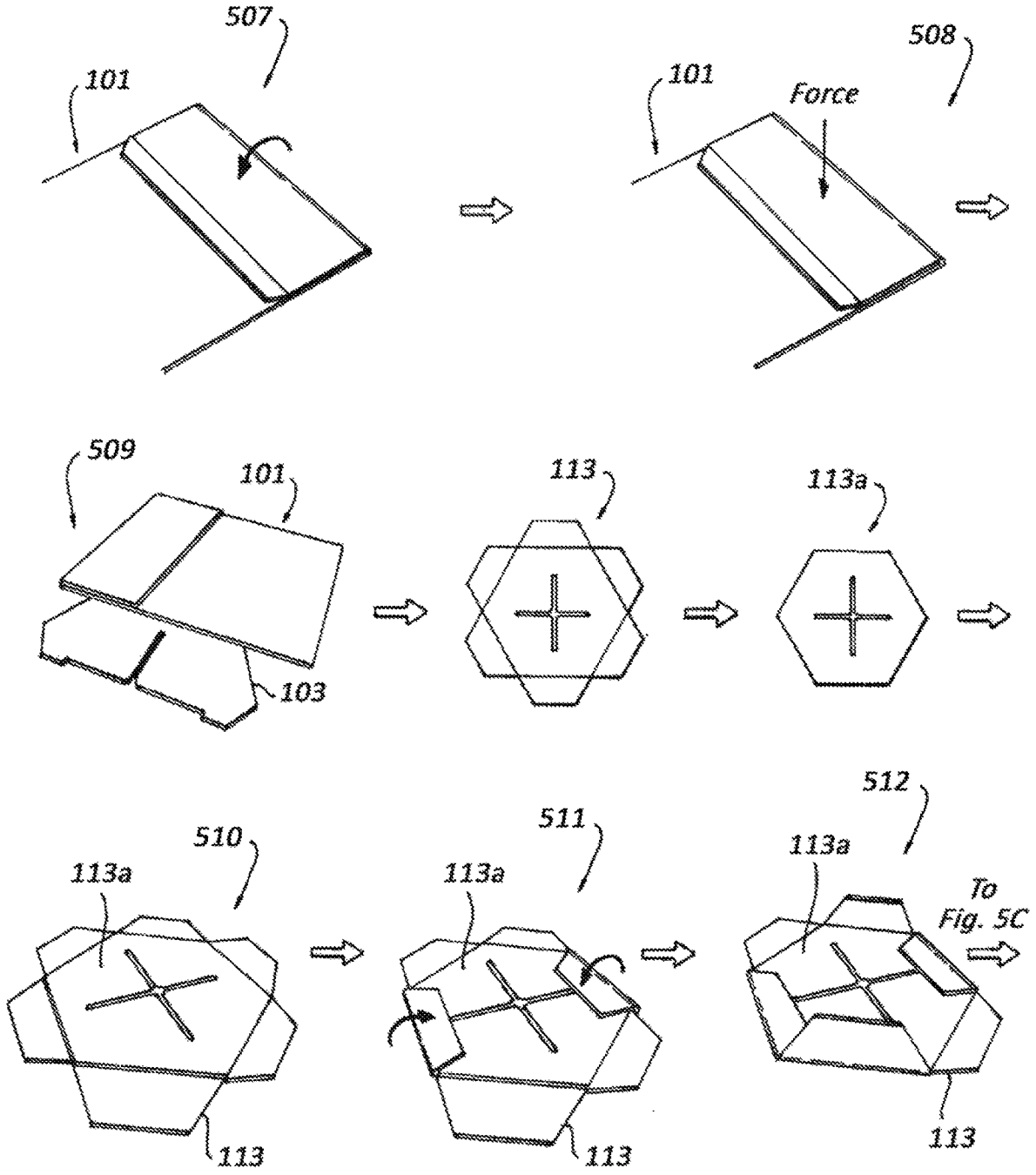

Referring to FIG. 5B, the method can include (e.g., at 507) folding the base 101 over and attaching the attachment tab 101*e* of the base to the sixth panel. The method can include (e.g., at 508) allowing glue to set, e.g., where glue is used. The method can include (e.g., at 510) placing a pad 113*a* on a shelf member 113 and then (e.g., at 511) folding and adhering a flap 113*c* to the pad 113*a*. The method can include repeating (e.g., at 512) for any other flaps 113*c*.

Figure 5C:
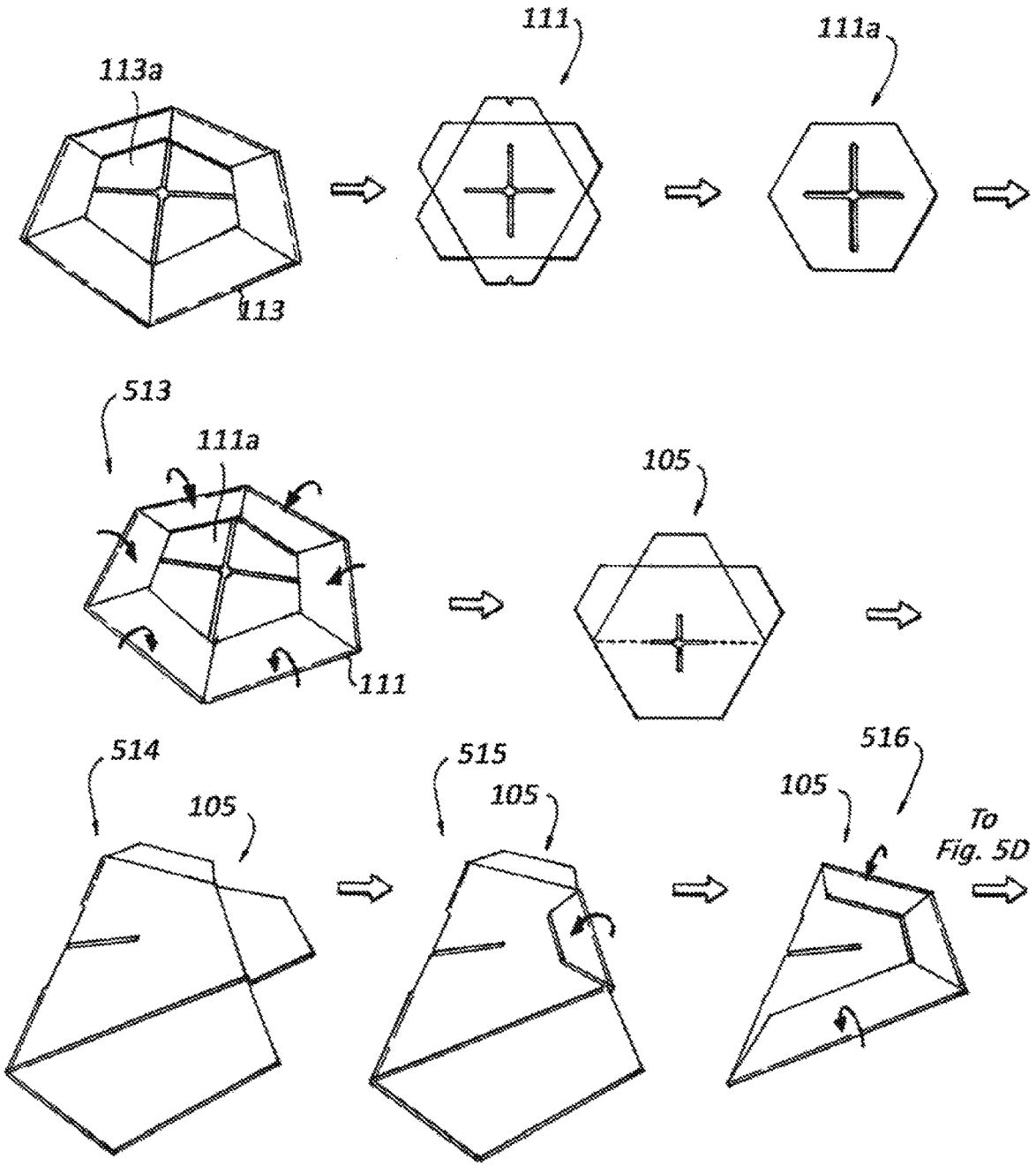

Referring to FIG. 5C, the method can include (e.g., at 513) repeating steps 510-512 for any other shelves 111. The method can include folding a second half 105*f* (e.g., at 514) of a table section 105 (e.g., and adhering to the body 105*e* with glue or tape). The method can include folding (e.g., at 515) a flap 105*c* over the second half 105*f* and adhering. The method can include repeating (e.g., at 516) for any other flaps 105*c* and for any other table sections 105.

Figure 5D:
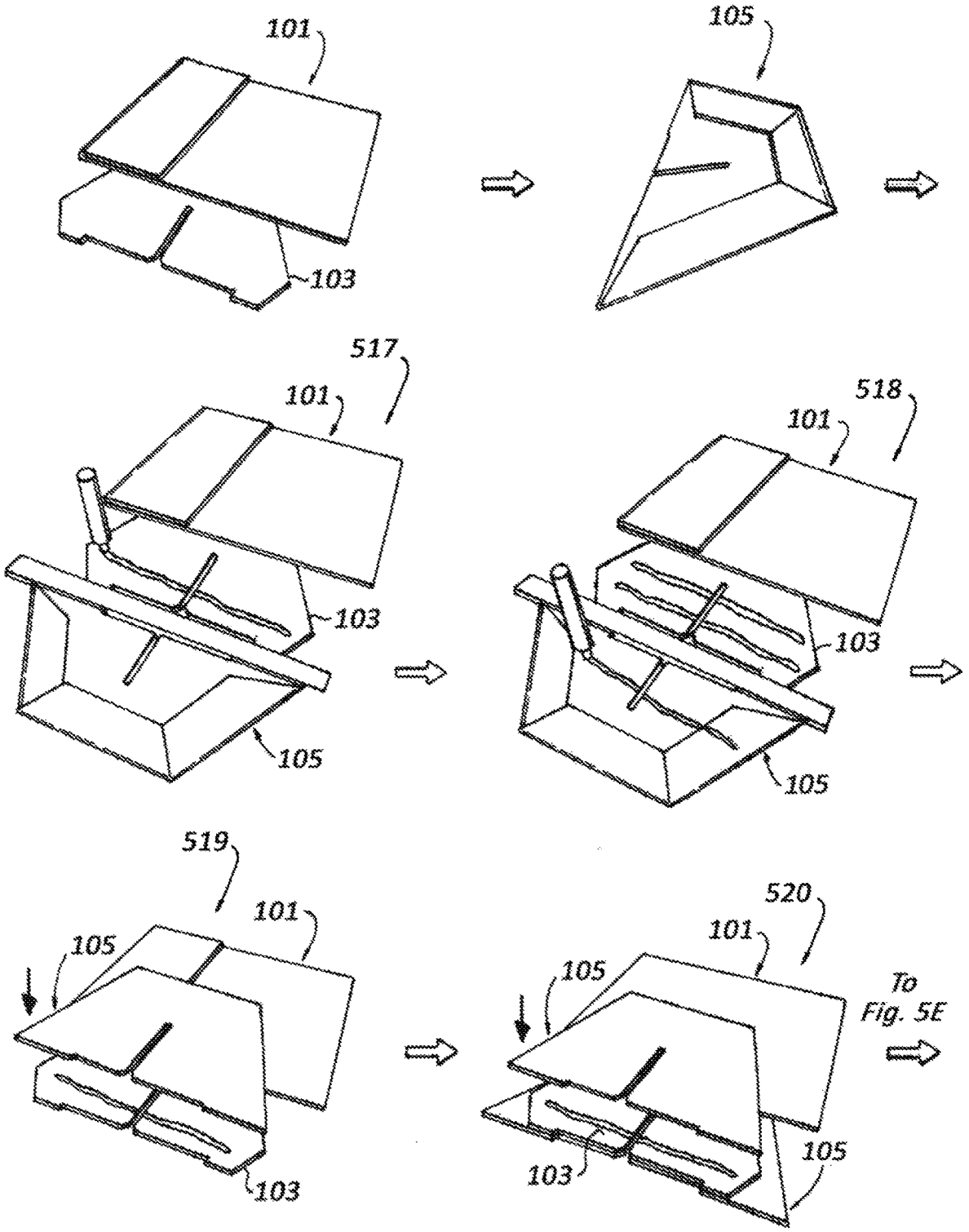

Referring to FIG. 5D, the method can include applying (e.g., at 517 and 518) glue or tape to an arm of a center support 103 and adhering (e.g., at 519) a table section 105 to the center support 103 while aligning the slits 105*a*, 103*j* thereof. The method can include (e.g., at 520) allowing a glue to set (e.g. using weights; where glue is used) and repeating for any other table sections 105 and center supports 103.

Figure 5E:
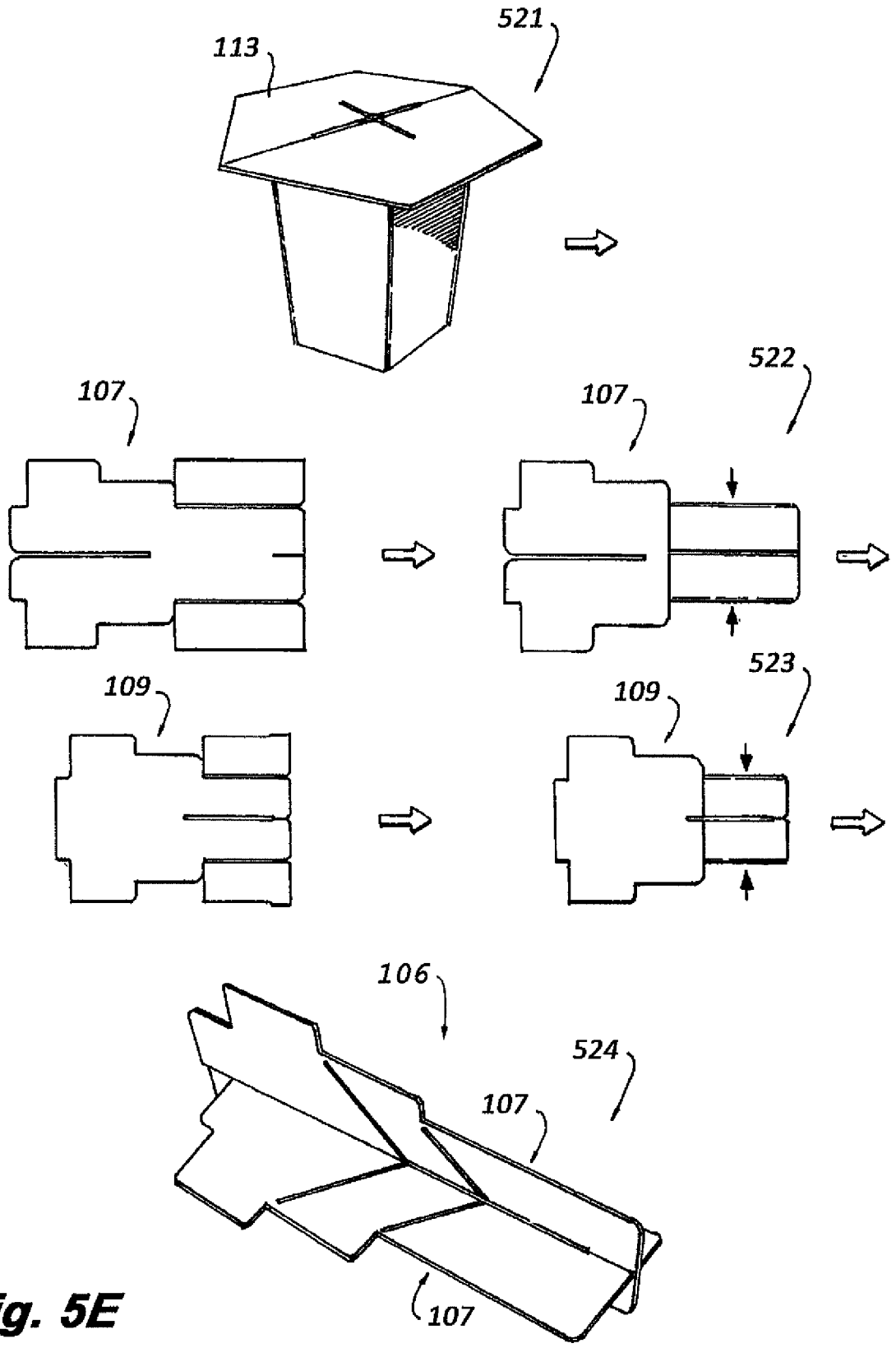

Referring to FIG. 5E, the method can include opening the table (e.g., at 521). The method can include folding and adhering (e.g., at 522) the reinforcement panels 107*c* of a first cross support member 107. The method can include repeating (e.g., at 523) for the other cross support member 109. The method can include (e.g., at 524) assembling the cross support using the cross support members 107, 109.

After assembly, all components may be placed in their flat folded positions and placed into a shipping box for shipment to an end user (e.g., a retailer). Any suitable portions of the method can be removed therefrom, and/or rearranged, and/or modified in any suitable manner. Any other suitable portions of a method can be added as well.

Certain embodiments described above enable shipment of a flat, thin box to an end user containing pre-assembled components. Certain embodiments can quickly fold out and/or be quickly inserted together to form a multi-tier display structure that is sturdy without requiring any gluing or taping by the end user.

Any suitable combination(s) of any disclosed embodiments and/or any suitable portion(s) thereof are contemplated herein as appreciated by those having ordinary skill in the art.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

Any dimensions and relative dimensions disclosed in the drawings are for example only, and can be taken in any unit (e.g., inches, centimeters, etc.). Any suitable dimensions are contemplated herein.

Any use of the singular form (e.g., use of the article "a" or "an") in this disclosure (e.g., in the specification or claims) is herein defined to also include plurals unless expressly disclaimed.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A collapsible structure, comprising:

a base having at least five hinges defined therein to define six or more base panels such that the base is foldable to form a shape with at least six sides, the base defining a first end and a second end that are attached to each other;

a first center support and a second center support, each center support including:

a body;

an upper arm defined by a first arm hinge and extending from the body, the first arm hinge allowing the upper arm to fold relative to the body; and a lower arm defined by a second arm hinge and extending from an opposite side of the body as the upper arm, the second arm hinge allowing the lower arm to fold relative to the body, wherein the first center support is attached to a first panel of the base within the base by the upper arm and lower arm of the first center support, wherein the second center support is attached to a second panel of the base within the base by the upper arm and lower arm of the second center support, the second panel being spaced from the first panel, wherein the first center support and the second center support are also attached together at the body of each center support the base is movable between a flat folded position and an open standing position by relative movement of the upper arms and the lower arms relative to the attached bodies of the center supports.

2. The structure of claim 1, wherein the upper arms of each center support extend from the base at least in the flat folded position.

3. The structure of claim 2, wherein the upper arms and the lower arms fold to a horizontal position when structure is moved to the open standing position.

4. The structure of claim 3, further comprising a first table section attached to the upper arm of the first center support and outside of the base, and a second table section attached to the upper arm of the second center support and outside of the base, such that when moved to the open standing position, the table sections are moved horizontal to at least partially form a table.

5. The structure of claim 4, wherein each center support comprises a bottom hinge defining a bottom attachment tab on the lower arm and a top hinge defining a top attachment tab on the upper arm, wherein the each center support is attached to the base at the each attachment tab.

6. The structure of claim 5, wherein each center support is folded over the bottom attachment tab.

7. The structure of claim 6, wherein the base further includes an attachment tab at the second end of the base that is defined by an additional hinge and configured to attach to an end panel of the base.

8. The structure of claim 4, wherein the upper arms include an upper arm slit, wherein the table sections each include a first section slit defined therein aligned with the upper arm slits and perpendicular to the body, and a second section slit perpendicular to the upper arm slits such that, in the open standing position, the table sections define a cross-shaped opening.

9. The structure of claim 8, wherein the body of each center support includes a cut out between the upper arm and the body.

10. The structure of claim 9, further comprising a cross support sized and shaped so as to be insertable into the cross-shaped opening in the table sections and to secure to the body, wherein the cross support member includes a first cross support member interfaced with a second cross support member connected to each other and being foldable between a cross flat position and cross open position.

11. The structure of claim 10, wherein the first cross support member includes a central bottom slit that is slidable over the body within the base and the second cross support member includes a central upper slit that is dimensioned so as to receive the first cross-support member to form the cross support.

12. The structure of claim 11, wherein each cross support includes a bottom tab that inserts through the cross shaped opening in the table.

13. The structure of claim 12, further comprising at least one shelf member, each shelf member comprising a cross opening that is slidable onto the cross support so as to allow said each shelf member to rest on a set of ribs of the cross support.

14. The structure of claim 13, wherein the cross support includes successively smaller diameter sets of ribs, and wherein each shelf includes a cross opening, wherein each successively higher shelf includes a smaller cross opening to rest on successive sets of ribs of the cross support.

15. The structure of claim 14, further comprising a hat configured to form a box to cover a top portion of the cross support.

16. The structure of claim 14, wherein each component is made of corrugated paper.

17. The structure of claim 16, wherein the hinges include living hinges defined by at least one of fold lines, score lines, intermittent cuts, and/or rail scores.

18. A method for assembling a collapsible structure, comprising:

providing a base, the base having at least five hinges defined therein to define six base panels such that the base is foldable to form a hexagon;

providing a first center support and a second center support, comprising:

a body;

an upper arm defined by a first arm hinge and extending from the body, the first arm hinge allowing the upper arm to fold relative to the body; and a lower arm defined by a second arm hinge and extending from an opposite side of the body as the upper arm, the second arm hinge allowing the lower arm to fold relative to the body, a bottom hinge defining a bottom attachment tab on the lower arm and a top hinge defining a top attachment tab on the upper arm;

attaching the first center support to a first panel of the base by the lower attachment tab of the first center support;

attaching a second center support to a second panel of the base by the lower attachment tab of the second center support, wherein the second panel is spaced from the first panel by two intermediate panels;

folding the first center support over the lower attachment tab to bring the first center support across the base;

folding the second center support over the lower attachment tab to bring the second center support across the base;

folding the upper arm of the first center support over and attaching the first center support to a first panel of the base by the top attachment tab of the first center support;

folding the upper arm of the second center support over and attaching the second center support to a second panel of the base by the top attachment tab of the second center support, folding the base between the two intermediate panels such that the body of each of the first center support and the second center support contact and join together via an adhesive or tape; and attaching a first end of the base to a second end of the base to enclose the center supports within the base such that the base is movable between a flat folded position and an open standing position by relative movement of the upper arms and the lower arms relative to the attached bodies of the first and second center supports.

19. The method of claim 18, further comprising attaching a first table section and a second table section to the upper arm of the first center support and the second center support after enclosing the center supports in the base such that, in the open standing position, the first and second table sections sit on the upper arms to form a table having a cross-shaped opening therein.

* * * * *